US006022099A

United States Patent [19]

Chwalek et al.

[11] Patent Number: 6,022,099

[45] **Date of Patent: *Feb. 8, 2000**

[54] INK PRINTING WITH DROP SEPARATION

[75] Inventors: James M. Chwalek, Pittsford; John A. Lebens, Rush, both of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/787,657

[22] Filed: Jan. 21, 1997

[51] Int. Cl.[7] ..... B41J 2/05

[52] U.S. Cl. ..... 347/57; 347/62

[58] Field of Search ..... 347/56, 62, 61, 347/48, 54, 57

[56] References Cited

U.S. PATENT DOCUMENTS

| | | | |
|---|---|---|---|
| 3,946,398 | 3/1976 | Kyser et al. | 347/70 |
| 4,166,277 | 8/1979 | Cielo et al. | 347/55 |
| 4,275,290 | 6/1981 | Cielo et al. | 347/56 X |
| 4,490,728 | 12/1984 | Vaught et al. | 347/60 |
| 4,532,530 | 7/1985 | Hawkins | 347/62 |
| 4,580,149 | 4/1986 | Domoto | 347/61 |
| 4,751,531 | 6/1988 | Saito et al. | 347/55 |
| 4,935,752 | 6/1990 | Hawkins | 347/62 |
| 4,947,193 | 8/1990 | Deshpande | 347/62 |
| 5,726,693 | 3/1998 | Sharma | 347/48 |
| 5,781,202 | 7/1998 | Silverbrook | 347/3 |

FOREIGN PATENT DOCUMENTS

| | | | |
|---|---|---|---|
| 0 498 293 A2 | 1/1992 | European Pat. Off. | B41J 2/155 |
| 61-225-61 | 10/1986 | Japan | B41J 3/04 |
| 62-202740 | 9/1987 | Japan | B41J 3/04 |
| 2-11331 | 1/1990 | Japan | B41J 2/05 |
| 6-71883 | 3/1994 | Japan | B41J 2/05 |
| 6-143576 | 5/1994 | Japan | B41J 2/05 |
| 2 007 162 | 5/1979 | United Kingdom | B41J 3/04 |

*Primary Examiner*—Joseph Hartary
*Attorney, Agent, or Firm*—Walter S. Stevens

[57] ABSTRACT

A liquid ink, drop on demand page-width print-head comprises a semiconductor substrate, a plurality of drop-emitter nozzles fabricated on the substrate; an ink supply manifold coupled to the nozzles; pressure means for subjecting ink in the manifold to a pressure above ambient pressure causing a meniscus to form in each nozzle; a means for applying heat to the perimeter of the meniscus in predetermined selectively addressed nozzles; and a means for combined selection and ejection of drops from the selectively addressed nozzles.

5 Claims, 3 Drawing Sheets

INK PRINTING WITH DROP SEPARATION

BACKGROUND OF THE INVENTION

1. Field of the Invention

This invention relates generally to the field of digitally controlled printing devices, and in particular to liquid ink drop-on-demand printheads which integrate multiple nozzles on a single substrate and in which a poised liquid meniscus on a nozzle is expanded and is separated for printing by thermal activation.

2. Background Art

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop-on-demand ink jet. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Other types of piezoelectric drop-on-demand printers utilize piezoelectric crystals in push mode, shear mode, and squeeze mode. Piezoelectric drop-on-demand printers have achieved commercial success at image resolutions up to 720 dpi for home and office printers. However, piezoelectric printing mechanisms usually require complex high voltage drive circuitry and bulky piezoelectric crystal arrays, which are disadvantageous in regard to manufacturability and performance.

Great Britain Pat. No. 2,007,162, which issued to Endo et al. in 1979, discloses an electrothermal drop-on-demand ink jet printer which applies a power pulse to an electrothermal heater which is in thermal contact with water based ink in a nozzle. A small quantity of ink rapidly evaporates, forming a bubble which causes drops of ink to be ejected from small apertures along the edge of the heater substrate. This technology is known as Bubblejet™ (trademark of Canon K.K. of Japan).

U.S. Pat. No. 4,490,728, which issued to Vaught et al. in 1982, discloses an electrothermal drop ejection system which also operates by bubble formation to eject drops in a direction normal to the plane of the heater substrate. As used herein, the term "thermal ink jet" is used to refer to both this system and the system commonly known as Bubblejet™.

Thermal ink jet printing typically requires a heater energy of approximately 20 $\mu$J over a period of approximately 2 $\mu$sec to heat the ink to a temperature 280–400° C. to cause rapid, homogeneous formation of a bubble. The rapid bubble formation provides the momentum for drop ejection. The collapse of the bubble causes a tremendous pressure pulse on the thin film heater materials due to the implosion of the bubble. The high temperatures needed necessitates the use of special inks, complicates the driver electronics, and precipitates deterioration of heater elements. The 10 Watt active power consumption of each heater is one of many factors preventing the manufacture of low cost high speed page width printheads.

U.S. Pat. No. 4,275,290, which issued to Cielo et al., discloses a liquid ink printing system in which ink is supplied to a reservoir at a predetermined pressure and retained in orifices by surface tension until the surface tension is reduced by heat from an electrically energized resistive heater, which causes ink to issue from the orifice and to thereby contact a paper receiver. This system requires that the ink be designed so as to exhibit a change, preferably large, in surface tension with temperature. The paper receiver must also be in close proximity to the orifice in order to separate the drop from the orifice.

U.S. Pat. No. 4,166,277, which also issued to Cielo et al., discloses a related liquid ink printing system in which ink is supplied to a reservoir at a predetermined pressure and retained in orifices by surface tension. The surface tension is overcome by the electrostatic force produced by a voltage applied to one or more electrodes which lie in an array above the ink orifices, causing ink to be ejected from selected orifices and to contact a paper receiver. The extent of ejection is claimed to be very small in the above Cielo patents, as opposed to an "ink jet", contact with the paper being the primary means of printing an ink drop. This system is disadvantageous, in that a plurality of high voltages must be controlled and communicated to the electrode array. Also, the electric fields between neighboring electrodes interfere with one another. Further, the fields required are larger than desired to prevent arcing, and the variable characteristics of the paper receiver such as thickness or dampness can cause the applied field to vary.

In U.S. Patent No. 4,751,531, which issued to Saito, a heater is located below the meniscus of ink contained between two opposing walls. The heater causes, in conjunction with an electrostatic field applied by an electrode located near the heater, the ejection of an ink drop. There are a plurality of heater/electrode pairs, but there is no orifice array. The force on the ink causing drop ejection is produced by the electric field, but this force is alone insufficient to cause drop ejection. That is, the heat from the heater is also required to reduce either the viscous drag and/or the surface tension of the ink in the vicinity of the heater before the electric field force is sufficient to cause drop ejection. The use of an electrostatic force alone requires high voltages. This system is thus disadvantageous in that a plurality of high voltages must be controlled and communicated to the electrode array. Also the lack of an orifice array reduces the density and controllability of ejected drops.

Each of the above-described ink jet printing systems has advantages and disadvantages. However, there remains a widely recognized need for an improved ink jet printing approach, providing advantages for example, as to cost, speed, quality, reliability, power usage, simplicity of construction and operation, durability and consumables.

Commonly assigned European Patent Application Ser. No. 97200748.8 filed in the name of Kia Silverbrook on Mar. 12, 1997, discloses a liquid printing system that affords significant improvements toward overcoming the prior art problems associated with drop size and placement accuracy, attainable printing speeds, power usage, durability, thermal stresses, other printer performance characteristics, manufacturability, and characteristics of useful inks. The invention provides a drop-on-demand printing mechanism wherein the means of selecting drops to be printed produces a difference in position between selected drops and drops which are not selected, but which is insufficient to cause the ink drops to overcome the ink surface tension and separate from the body of ink, and wherein an additional means is provided to cause separation of said selected drops from said body of ink. To cause separation of the drop the system requires either proximity mode, for which the paper receiver must be in close proximity to the orifice in order to separate the drop from the orifice, or the use of an electric field between paper receiver and orifice which increases the system complexity and has the possibility of arcing.

One of the objects of the present invention is to retain the improvements of the above invention, but also demonstrate a new mode of operation of this device. This mode, which was not previously predicted, causes repeatable separation of the drop propelling it to the paper receiver without the need for proximity or an electric field.

SUMMARY OF THE INVENTION

It is an object of the present invention to demonstrate a new mode of operation for a drop-on-demand printhead wherein electrothermal pulses applied to an annular heater located around the rim of a nozzle control both expansion of a poised meniscus into a drop and also produces separation of the drop, propelling it to the paper receiver. Electrothermal pulses applied to selected nozzles heat the ink in those nozzles, altering material properties of the ink, including a reduction in the surface tension of the ink and causing it to expand past its initially poised state. Heating the ink adjacent to the heater surface to a temperature greater than its boiling point results in separation of the drop. After separation the meniscus quickly relaxes to its equilibrium poised position ready for the next drop ejection.

BRIEF DESCRIPTION OF THE DRAWINGS

FIG. 1(*b*) shows a cross section of the nozzle tip in accordance with the present invention.

FIG. 1(*c*) shows a top view of the nozzle tip in accordance with the present invention.

DESCRIPTION OF THE PREFERRED EMBODIMENT

Figure 1A:
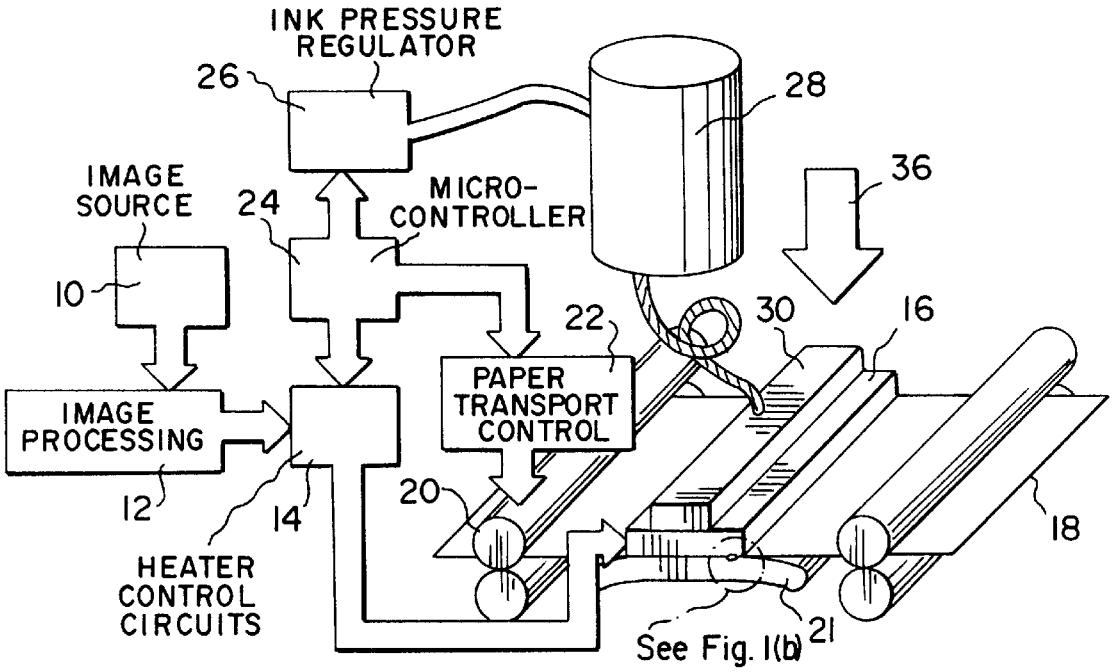
FIG. 1(*a*) shows a simplified block schematic diagram of one exemplary printing apparatus in which the present invention is useful.
Figure 1B:
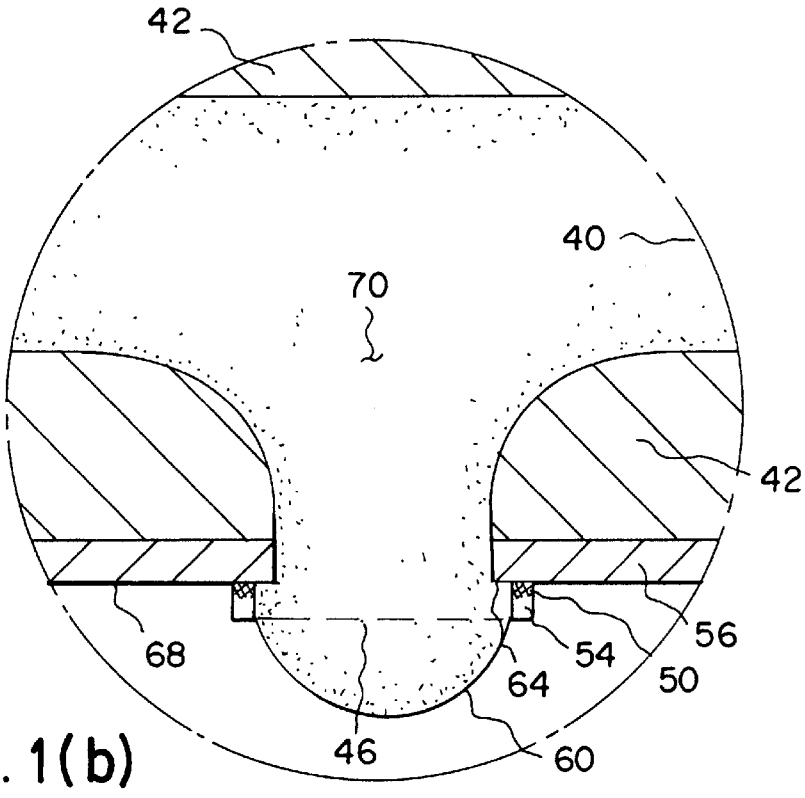
Figure 1C:
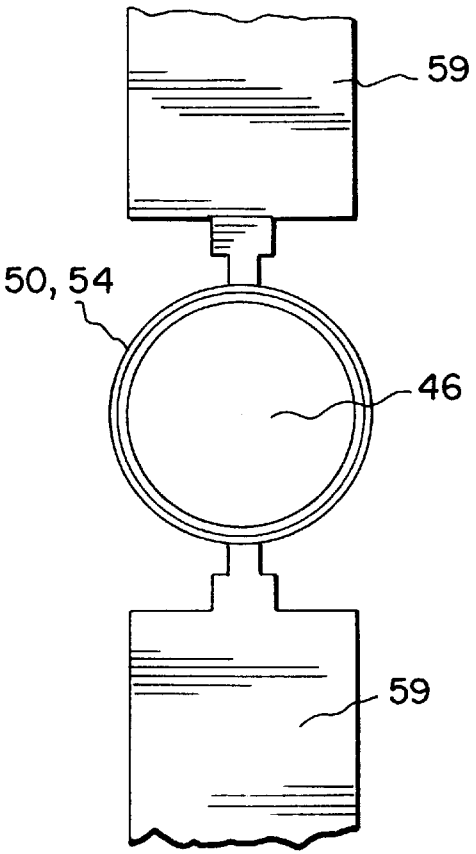

FIG. 1(*a*) is a drawing of a drop on demand ink jet printer system utilizing the ink jet head with drop separation means. An image source 10 may be raster image data from a scanner or computer, or outline image data in the form of a page description language, or other forms of digital image representation. This image data is converted to half-toned bitmap image data by an image processing unit 12 which also stores the image data in memory. Heater control circuits 14 read data from the image memory and apply time-varying electrical pulses to the nozzle heaters that are part of a printhead 16. These pulses are applied at an appropriate time, and to the appropriate nozzle, so that selected drops will form spots on a recording medium 18 in the appropriate position designated by the data in the image memory. Optimal operation refers to an operating state whereby ink drops are separated and ejected from one or more pressurized nozzle orifices by the application of electrical pulses to the heater surrounding the nozzle without the need for an external drop separation means.

Recording medium 18 is moved relative to printhead 16 by a paper transport system 20, which is electronically controlled by a paper transport control system 22, which in turn is controlled by a micro-controller 24. A paper guide or platen 21 is shown directly below printhead 16. The paper transport system shown in FIG. 1(*a*) is schematic only, and many different mechanical configurations are possible. In an alternative embodiment, a transfer roller could be used in place of the paper transport system 20 to facilitate transfer of the ink drops to recording medium 18. Such transfer roller technology is well known in the art. In the case of page width printheads, it is most convenient to move recording medium 18 past a stationary printhead 16. However, in the case of scanning print systems, it is usually most convenient to move printhead 16 along one axis (the sub-scanning direction) and recording medium 18 along the orthogonal axis (the main scanning direction), in a relative raster motion.

Micro-controller 24 may also control an ink pressure regulator 26 and heater control circuits 14. Ink is contained in an ink reservoir 28 under pressure. In the quiescent state (with no ink drop ejected), the ink pressure is insufficient to overcome the ink surface tension and eject a drop. The ink pressure for optimal operation will depend mainly on the nozzle orifice diameter, surface properties (such as the degree of hydrophobicity) of the bore 46 and the rim 54 of the nozzle, surface tension of the ink, and power as well as temporal profile of the heater pulse. A constant ink pressure can be achieved by applying pressure to ink reservoir 28 under the control of ink pressure regulator 26. Alternatively, for larger printing systems, the ink pressure can be very accurately generated and controlled by situating the top surface of the ink in reservoir 28 an appropriate distance above printhead 16. This ink level can be regulated by a simple float valve (not shown). The ink is distributed to the back surface of printhead 16 by an ink channel device 30. The ink preferably flows through slots and/or holes etched through the silicon substrate of printhead 16 to the front surface, where the nozzles and heaters are situated.

FIG. 1(*b*) is a detail enlargement of a cross-sectional view of a single nozzle tip of the drop-on-demand ink jet printhead 16 according to a preferred embodiment of the present invention. An ink delivery channel 40, along with a plurality of nozzle bores 46 are etched in a substrate 42, which is silicon in this example. In this example, delivery channel 40 and nozzle bore 46 were formed by anisotropic wet etching of silicon, using a $p^+$ etch stop layer to form the shape of nozzle bore 46. Ink 70 in delivery channel 40 is pressurized above atmospheric pressure, and forms a meniscus 60 which protrudes somewhat above nozzle rim 54, at a point where the force of surface tension, which tends to hold the drop in, balances the force of the ink pressure, which tends to push the drop out.

In this example, the nozzle is of cylindrical form, with heater 50 forming an annulus. The heater is made of polysilicon doped at a level of about 30 ohms/square, although other resistive heater material could be used. Nozzle rim 54 is formed on top of heater 50 to provide a contact point for meniscus 60. The width of the nozzle rim in this example is 0.6–0.8 $\mu$m. Heater 50 is separated from substrate 42 by thermal and electrical insulating layers 56 to minimize heat loss to the substrate.

The layers in contact with the ink can be passivated with a thin film layer 64 for protection, which can also include a layer to improve wetting of the nozzle with the ink in order to improve refill time. The printhead surface can be coated with a hydrophobizing layer 68 to prevent accidental spread of the ink across the front of the printhead. The top of nozzle rim 54 may also be coated with a protective layer which could be either hydrophobic or hydrophillic.

FIG. 1(*c*) is an enlargement of a top view of a single nozzle of drop-on-demand ink jet printhead 16 according to a preferred embodiment of the present invention. Nozzle rim 54 and heater annulus 50 located directly under nozzle rim 54 surrounds the periphery of nozzle bore 46. A pair of power and ground connections 59 from the drive circuitry to heater annulus 50 are shown, and are fabricated to lie in the heater plane below the nozzle rim.

Heater control circuits 14 supply electrical power to the heater for a given time duration. Optimum operation provides a sharp rise in temperature at the start of the heater pulse, a maintenance of the temperature above the boiling point of the ink in an annular volume just to the ingress of the nozzle/heater interface for part of the duration of the heater pulse, and a rapid fall in temperature at the end of the heater pulse. The power and duration of the applied heater pulse that is necessary to accomplish this depends mainly on the geometry and thermal properties (such as thermal conductivity, specific heat, and density) of the materials in and around the heater including the thermal properties of the ink as well as the surface tension and viscosity of the ink. Thermal models can be used to guide the selection of geometrical parameters and materials as well as operating ranges of the ink pressure, heater pulse power and duration. It is recognized that a certain degree of experimentation may be necessary to achieve the optimal conditions for a given geometry.

For small drop sizes, gravitational force on the ink drop is very small; approximately $10^{-4}$ of the surface tension forces, so gravity can be ignored in most cases. This allows printhead 16 and recording medium 18 to be oriented in any direction in relation to the local gravitational field. This is an important requirement for portable printers.

In an alternative embodiment, an external field 36 is used to aid in the separation of the ink drop from the body of the ink and accelerate the drop towards the recording medium 18. A convenient external field 36 (FIG. 1(*a*)) is a constant or pulsed electric field, as the ink is easily made to be electrically conductive. In this case, paper guide or platen 21 can be made of electrically conductive material and used as one electrode generating the electric field. The other electrode can be printhead 16 itself.

Figure 2:
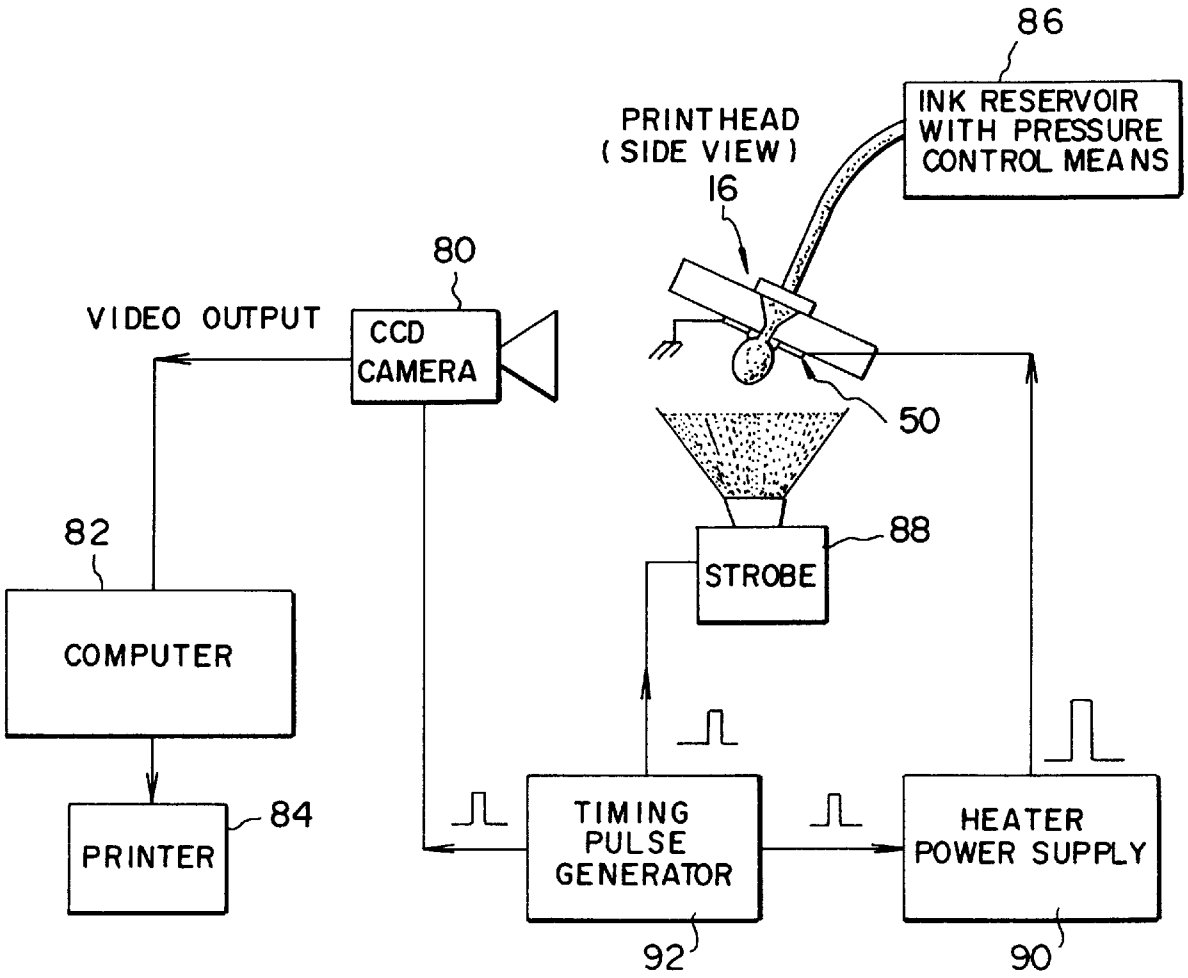
FIG. 2 shows a simplified block schematic diagram of the experimental setup used to test the present invention.

The ink jet head with drop separation means shown schematically in FIGS. 1(*b*) and 1(*c*) was fabricated as described above and experimentally tested. A schematic diagram of the experimental set up used to image drops emitted from printhead 16 is shown in FIG. 2. A CCD camera 80 connected to a computer 82 and printer 84 is used to record images of the drop at various delay times relative to the heating pulse. Printhead 16 is angled at 30 degrees from the horizontal so that the entire heater 50 can be viewed. Because of the reflective nature of the surface, a reflected image of the drop appears together with the imaged drop. An ink reservoir and pressure control means 86 shown as one unit is included to poise the ink meniscus at a point below the threshold of ink release. A fast strobe 88 is used to freeze the image of the drop in motion. A heater power supply 90 is used to provide a current pulse to heater 50. Strobe 88, camera 80, and heater power supply 90 may be synchronously triggered by a timing pulse generator 92. In this way, the time delay between strobe 88 and heater power supply 90 may be set to capture the drop at various points during its formation.

Figures 3A, 3B, 3C, 3D, 3E:
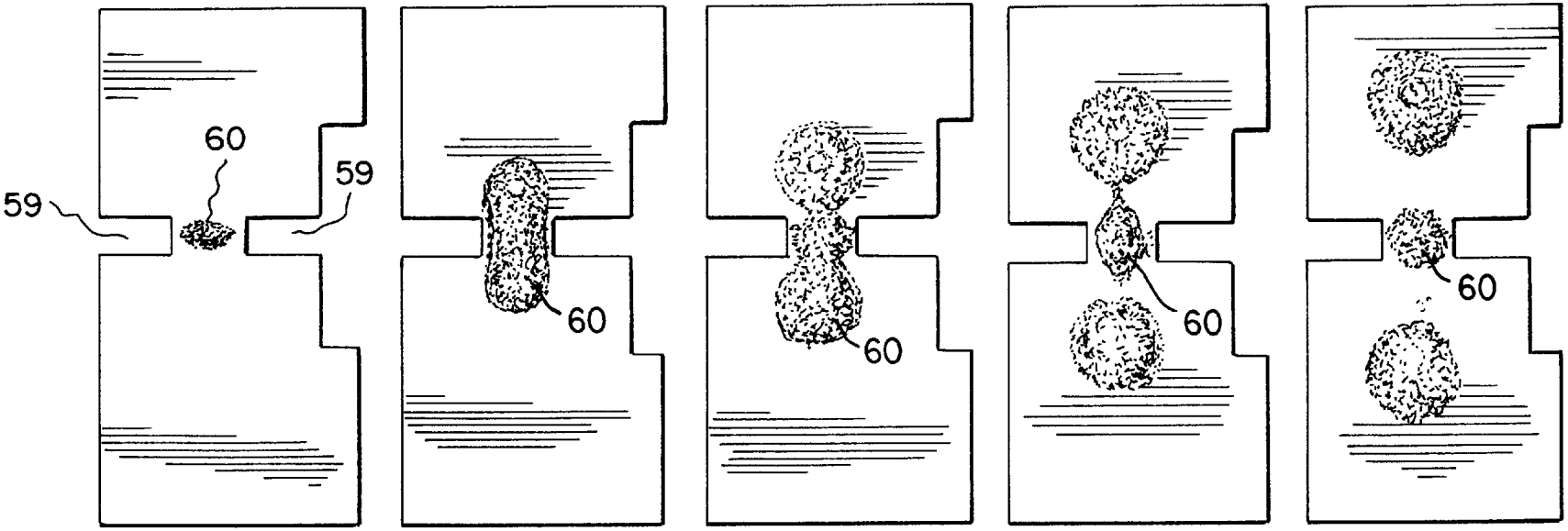
FIGS. 3(*a*) to 3(*e*) shows a drop ejection cycle in accordance with the present invention.

Experimental Results:

A 16 $\mu$m diameter nozzle, fabricated as described above and shown schematically in FIGS. 1(*b*) and 1(*c*), was mounted in the test setup shown schematically in FIG. 2. The nozzle reservoir was filled with de-ionized water. The nozzle did not contain a hydrophobizing/anti-wetting layer although it is believed that such a layer as described earlier would improve operation. FIG. 3(*a*) is an image of a meniscus 60 poised on nozzle lip 54 by pressurizing reservoir 86 to 13.0 kPa, below the measured critical pressure of 17.0 kPa. Note that the image is taken at a tilt of 30 degrees from horizontal with a reflected image of the poised meniscus also appearing. Also labeled on the image are electrodes 59.

FIG. 3(*b*) is an image taken of the meniscus 42 $\mu$s after the start of a 60 $\mu$s, 115 mW electrical pulse applied to heater 50. The local increase in temperature caused by the thermal energy from the heater has changed some of the physical properties of the de-ionized water including decreasing the surface tension and viscosity. The surface tension reduction causes meniscus 60 to move further out of the nozzle. FIG. 3(*c*) is an image taken 62 $\mu$s after the start of the heater pulse. At this point a decrease in the diameter of the extended meniscus in a region close to the nozzle orifice can clearly be seen. This extended meniscus continues to neck down, as can be seen from FIG. 3(*d*), which shows an image taken 82 $\mu$s after the start of the heater pulse. Finally, in FIG. 3(*e*), 102 $\mu$s after the start of the heater pulse, the drop is completely separated from the body of de-ionized water leaving behind a poised meniscus.

The invention has been described in detail with particular reference to preferred embodiments thereof, but it will be understood that variations and modifications can be effected within the spirit and scope of the invention.

What is claimed is:

1. An ink ejecting printhead comprising:

a substrate having an ink-emitting nozzle bore with a rim;

a heater on the substrate surrounding the rim of the nozzle bore;

an ink supply communicating with the nozzle bore to supply ink, whose surface tension decreases inversely with its temperature, to the nozzle bore under positive pressure relative to ambient pressure to form a meniscus which protrudes above the nozzle rim at a point where the force of surface tension which tends to hold the drop in, balances the force of the ink pressure, which tends to push the drop out;

an electrical power supply connected to the heater; and a power supply control for regulating the power supplied to the heater to provide an electrical pulse of sufficient amplitude and duration to heat the ink adjacent to the heater to lower surface tension of the ink in order to cause the meniscus to move further out of the nozzle bore and subsequently to further heat the ink to a temperature greater than its boiling point, thereby causing separation of ink from the nozzle bore.

2. An ink ejecting printhead as set forth in claim 1 wherein the nozzle bore and the heater are annular.

3. An ink ejecting printhead as set forth in claim 1 wherein the heater is made at least in part of polysilicon doped at a level of about 30 ohms/square.

4. An ink ejecting printhead as set forth in claim 1 further comprising a thermal and electrical layer separating said substrate and the heater.

5. A process for ejecting ink from a printhead, said process comprising the steps of:

communicating an ink supply, whose surface tension decreases inversely with its temperature, with an ink-emitting nozzle bore to supply ink, the nozzle bore having a rim;

applying positive pressure relative to ambient to the ink supply to form a meniscus which protrudes above the nozzle rim at a point where the force of surface tension which tends to hold the drop in, balances the force of the ink pressure, which tends to push the drop out; and applying heat to the ink at the nozzle bore of sufficient temperature and duration to heat the ink to lower surface tension of the ink in order to cause the meniscus to move further out of the nozzle bore and subsequently further to heat the ink to a temperature greater than its boiling point, thereby causing separation of ink from the nozzle bore.

* * * * *